United States Patent [19]

Mayes

[11] 4,144,600

[45] Mar. 20, 1979

[54] LIQUID VOLUME CONTROL FOR A LIQUID STORAGE TANK

[76] Inventor: Robert Mayes, 10763 Big Bend Ave., Sunland, Calif. 91040

[21] Appl. No.: 862,025

[22] Filed: Dec. 19, 1977

[51] Int. Cl.[2] ..... E03D 1/14; E03D 3/12

[52] U.S. Cl. ..... 4/324; 4/325; 4/326

[58] Field of Search ..... 4/364, 415, 327, 326, 4/325, 324

[56] References Cited

U.S. PATENT DOCUMENTS

| | | | |
|---|---|---|---|
| 413,586 | 10/1889 | Wellington | 4/364 |
| 485,155 | 10/1892 | Herdegen | 4/364 |
| 2,863,153 | 12/1958 | Gerritsen | 4/364 |
| 3,946,447 | 3/1976 | Moon | 4/415 |

*Primary Examiner*—Henry K. Artis
*Attorney, Agent, or Firm*—Jack C. Munro

[57] ABSTRACT

A device for selecting either a first volume of liquid or second volume of liquid to be used in a flush cycle of a typical toilet tank. The device consists of a damming wall which separates the toilet tank into a pair of compartments. A valve assembly is associated with the damming wall which can be moved to either permit discharge of both compartments simultaneously or to permit discharge of only a single compartment.

8 Claims, 4 Drawing Figures

LIQUID VOLUME CONTROL FOR A LIQUID STORAGE TANK

BACKGROUND OF THE INVENTION

The field of this invention relates to a liquid level control device for a liquid storage tank in which the liquid storage tank is emptied periodically. More particularly, the device of this invention is designed to be employed in conjunction with the water storage tank of a conventional flushing toilet (water closet). But it is to be considered to be within the scope of this invention to use the structure of this invention in any liquid storage tank environment in which it is desired to regulate the discharge of a volume from the tank.

Within almost every home, there is at least one toilet and in many instances, a plurality of toilets. The conventional toilet construction employs a bowl into which waste is to be conducted and the waste is to be discharged from the bowl by means of a quantity of water which is located within a storage tank attached to the bowl. The storage tank has a water supply inlet and a water supply outlet. The tank includes a flotation system of some type which permits water to be supplied into the tank and maintained at an upper or full level. Therefore, upon actuation of a valve assembly, connected with the outlet of the tank, the stored water in the tank will be discharged rapidly into the toilet bowl.

Normally, the waste deposited in the bowl can take the form of either a liquid waste or a solid waste. Generally, a bigger volume of water is required to discharge the solid waste than is required to discharge the liquid waste. In the greatest percentage of instances, the requirement is to discharge the liquid waste, but the volume of water being supplied into the bowl is what is required to discharge solid waste. Actually, the amount of water required to discharge solid waste versus that to discharge liquid waste is about twice as great. Because of the substantial number of toilets in use, this means that a substantial amount of water is being needlessly discharged into sanitation systems which could be used for other purposes such as bathing and drinking.

Previously, there have been attempts to limit the amount of water used in the flushing of a conventional toilet. In most instances, these attempts have been only to use a decreased volume of flushing water, not permitting a selection of the amount of water which is discharged into the toilet bowl. Therefore, such devices work satisfactorily with the disposal of liquid waste, but do not work satisfactorily with the disposal of solid waste.

There have been prior attempts at designing devices which vary the volume of water that is discharged into the toilet bowl. However, these devices have employed a complex arrangement of floats and valves and have therefore, been quite complex in construction and not economically feasible. Also, because of their complexity, a breakdown of the device is not at all uncommon.

SUMMARY OF THE INVENTION

The structure of this invention is directed to a device which facilitates selecting of either a full volume of water or a half volume of water in the flushing cycle of the conventional toilet. The operator can quickly and easily select either volume of water prior to initiating the flushing cycle. Within the toilet tank is located a damming wall which separates the toilet tank into a pair of separate water storage compartments. With the device in the one half flushing volume, only one of the compartments is emptied during flushing with the other of the compartments remaining full with water. With the device in the full flushing position, both compartments are emptied simultaneously, therefore, providing the normal total amount of water available for the flushing operation.

The primary objective of this invention is to provide a water saving device.

A further objective of this invention is to construct a water saving device for a conventional toilet which is composed of two parts and can be quickly and easily installed by an unskilled person.

A secondary objective of this invention is to construct a device which is independent of the existing toilet flushing mechanism, therefore, permitting the device to be installed after manufacture of the toilet or permitting the device to be installed in conjunction with the manufacture of the toilet.

DETAILED DESCRIPTION OF THE SHOWN EMBODIMENT

Figure 1:
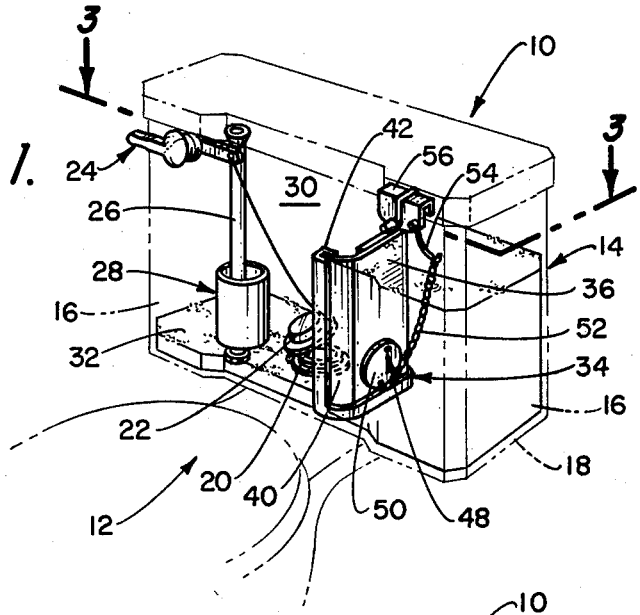
FIG. 1 is an isometric view of the device of this invention as it is installed within a conventional toilet water storage tank showing the device in the one-half flushing position.

Referring particularly to the drawing, there is shown a typical toilet tank having a conventional toilet bowl 12 into which is to be discharged waste and also a volume of water from liquid storage tank 14. The liquid storage tank 14 includes an interior liquid storage chamber 16. The bottom 18 includes an outlet opening 20 which is normally closed by a valve member 22. The valve member 22 is open by means of a lever assembly 24 which is to be manually operated by the user. Water is to be supplied into the chamber 16 through water supply tube 26 from its source (not shown).

A float assembly 28, that is deemed to be of conventional construction is to interconnect with a valve assembly, not shown, to supply water from said supply tube 26 within the chamber 16. Once the level of water has reached a desired level, the float assembly 28 will function to prevent further entry of water into the chamber 16.

It is believed to be readily apparent that upon conventional activation of lever assembly 24, the liquid contained within the chamber 16 will be discharged through the outlet 20 and into the toilet bowl 12. Upon the desired total volume of water within the chamber 16 having being discharged through the outlet 20, the valve assembly 22 will be moved to close outlet 20 and therefore permit refilling of the chamber 16 with water. When the chamber 16 is filled to the level 30, the chamber 16 is deemed to be full. With the water at the level 32, the water within the chamber 16 is deemed to be empty.

The structure of this invention, that is now to be explained, constitutes a damming wall 34. The material of the construction of the damming wall 34 will normally be of a sheet material such as plastic.

The damming wall 34 includes a center section 36 which is integrally connected to side sections 38 and 40. The side sections 38 and 40 are bendable with respect to the center section 36. This is due to the fact that the center section is of greater thickness that the side sections 38 and 40. The reason for the bending of the damming wall 34 is so to facilitate installation within the chambers 16, and once it is in place, upon release of the wall 34, the sealing edge 42 is biased into tight contact with the interior wall of the chamber 16. Also it has been noted that the sealing edge 42 extends along the bottom of the damming wall 34. Therefore, because of sealing arrangement, the interior chamber 16 is separated into a pair of smaller chambers, one of which includes the inlet supply pipe 26 and the outlet valve 22, with the other chamber not containing any of the conventional flushing apparatus.

Included within the rigid section 36 of the wall 34 is an enlarged opening 44. The opening 44 permits circulation of water between the pair of chambers located within the internal chamber 16. A second opening 46 is located within the damming wall 34 adjacent the opening 44 with the opening 46 being substantially smaller in size than the opening 44. The opening 46 may be provided through the center of a rivet assembly 48 which is used to secure thin sheet material rubber valve member 50. The valve member 50 is capable of resting against the surface of the rigid section 36 and close the opening 44.

Opening 46 is continuously open and it is for the purpose that within some toilets, the float assembly 28 will comprise a float ball which is attached to an elongated arm which extends over the damming wall 34 with the float ball resting upon the surface of the water located in the dammed chamber. In such an instance, if the toilet was one-half flushed, water from within the stored compartment would be conducted slowly through the opening 46 into the empty chamber. This would permit the float ball to drop, to physically fall so as to reactivate the valve mechanism associated with the supply conduit 26 and therefore permit the chamber 16 to refill with water. Upon the chamber 16 becoming completely filled, the water within the stored compartment will also rise until the valve mechanism associated with the water supply pipe 26 causes closure of the pipe 26.

The valve member 50 is connected to a chain 52. The chain 52 is connected to actuating lever 54. The lever 54 is mounted on a plate 56 which is positioned over the edge of the toilet tank 14. The lever 56 is movable between a half flushed position or a full flushed position as is apparent from the drawing. In the half flushed position, the valve member 50 is as located within FIG. 1. In the full flushed position, the valve member 50 is as located in FIG. 2.

In the operation of the device of this invention, if the lever 54 is located in the half flushed position, and the toilet is operated as normal, the water within the compartment of the outlet 20 is emptied and is discharged into the toilet bowl 12. As the water level lowers and approaches the valve member 50, there is an unequal pressure difference with respect to the valve member 50. This unequal pressure differential is caused by the volume of water within the stored chamber and the complete lack of water within the empty chamber. This causes the valve member 50 to be tightly pressed against the section 36 of the damming wall 34 thereby closing the opening 44. Therefore leakage of water from the stored compartment of water through the opening 44 is prevented.

Figure 2:
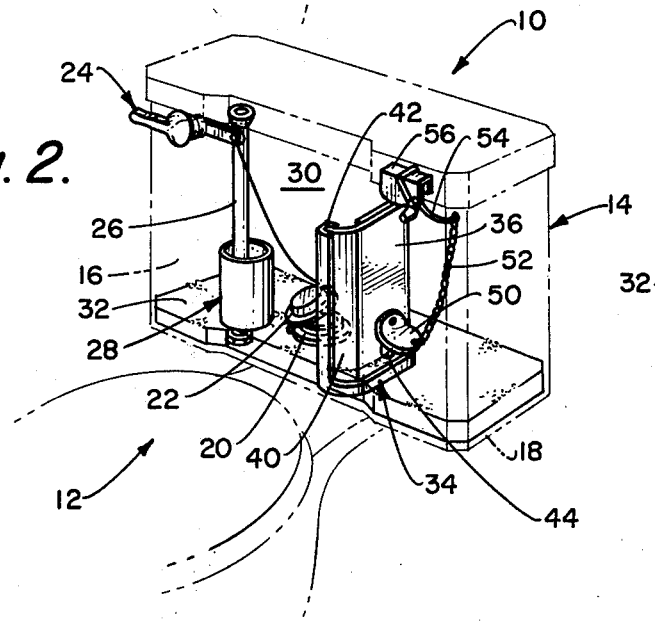
FIG. 2 is a view similar to FIG. 1 but showing the device in the full flushing position.
Figure 4:
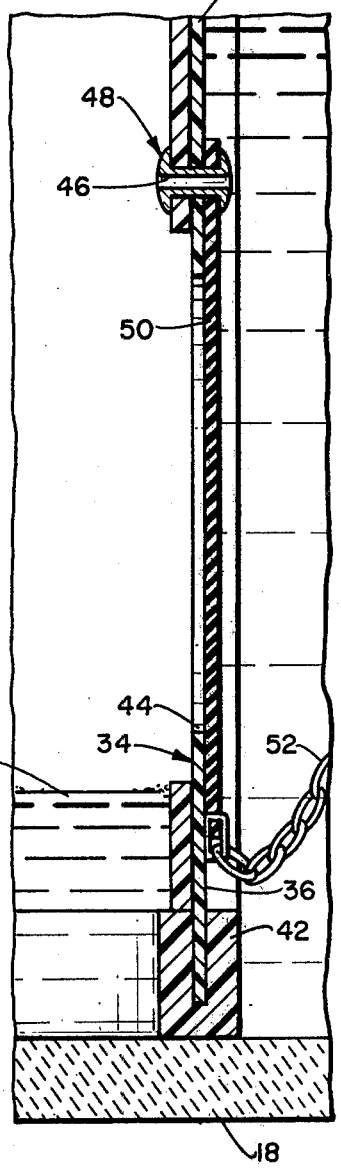
FIG. 4 is a cross sectional view through the valve assembly employed within the device of this invention taken along line 4—4 of FIG. 3.
Figure 3:
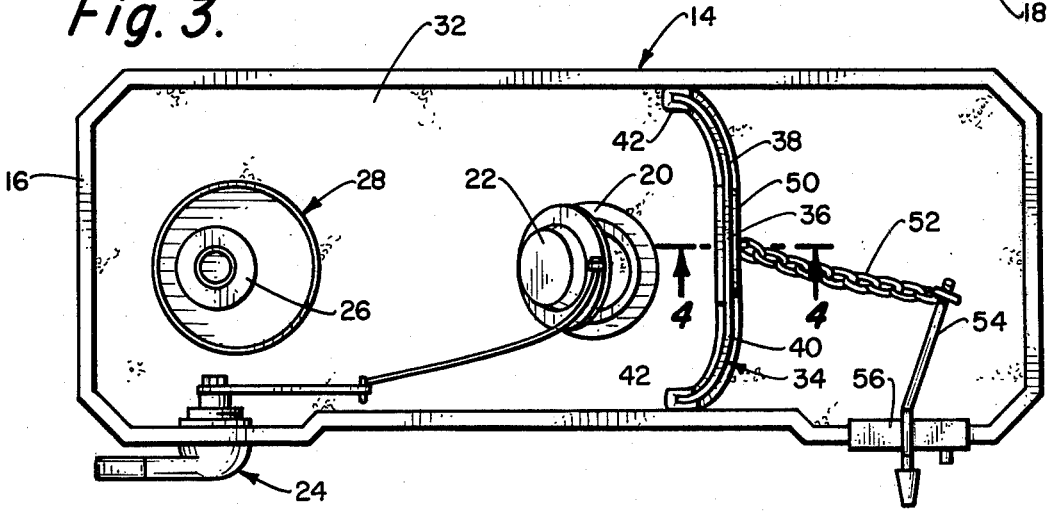
FIG. 3 is a top view of the device of this invention taken along line 3—3 of FIG. 1.

When it is desired to operate the toilet for a full flush, the lever 54 is moved into the position shown in FIG. 2. This holds the valve member 50 in the open position which permits the water to pass through the stored compartment directly into the compartment which contains the outlet 20. Therefore during a flushing operation, the full volume of water contained within the chamber 16 is permitted to flow into the toilet basin 12.

Therefore, what is claimed is:

1. In combination with a tank having an interior liquid storage chamber, a liquid inlet connected to said tank for supplying liquid into said storage chamber, an outlet located within said tank for exit of liquid from said storage chamber, an outlet valve assembly connected with said outlet, said outlet valve assembly being movable between a closed position preventing exit of liquid from said storage chamber and an open position permitting exit of liquid from said storage chamber, the improvement comprising:

a damming wall located within said tank separately dividing said storage chamber into a first chamber and a second chamber, said damming wall being in snug substantially water-tight contact with the wall surface of said storage chamber but not fixed to said wall surface by any fastening device thereby facilitating location and removal of said damming wall, both said outlet and said inlet connecting with said first chamber, said storage chamber having a pre-established first level for liquid when full and a second level for liquid when empty;

a first opening located within said damming wall intermediate said first level and said second level of liquid but substantially nearer said second level, said first opening connecting with a valve member, said valve member being attached to said damming wall and being formed of thin, flexible sheet material, said valve member being movable between a closed position completely covering said first opening and preventing passage of liquid therethrough and an open position permitting passage of liquid therethrough between said first and second chambers; and actuation means connected to said valve member, said actuation means movable between a first location and a second location, with said actuation means in said first location the said valve member being in said closed position when liquid within said second chamber is at or near said first level and liquid within said first chamber is at or near said second level, with said actuation means in said first location with liquid in both said first and second chambers at or near said first level the said valve member being located in said open position permitting circulation of liquid between said first and said second chambers, with said actuation means in said second location the said valve member being located in said open position permitting said second chamber to discharge liquid into said first chamber.

2. The combination as defined in claim 1 wherein:

said damming wall being of a heighth less than said first level of liquid.

3. The combination as defined in claim 1 wherein:

said valve member being of a rubber composition.

4. The combination as defined in claim 1 including:

a second opening located within said damming wall, the size of said second opening being substantially less than the size of said first opening, said second opening to permit a small amount of leakage between said second chamber and said first chamber.

5. The combination as defined in claim 1 wherein:

said damming wall being substantially convex with respect to said second chamber, the center portion of said damming wall from said second level to said first level being substantially rigid with the sides of said damming wall being bendable.

6. The combination as defined in claim 2 wherein:

said valve member being of a rubber composition.

7. The combination as defined in claim 6 wherein:

a second opening located within said damming wall, the size of said second opening being substantially less than the size of said first opening, said second opening to permit a small amount of leakage between said second chamber and said first chamber.

8. The combination as defined in claim 7 wherein:

said damming wall being substantially convex with respect to said second chamber, the center portion of said damming wall from said second level to said first level being substantially rigid with the sides of said damming wall being bendable.

* * * * *